US009318078B2

(12) United States Patent
McIntyre et al.

(10) Patent No.: US 9,318,078 B2
(45) Date of Patent: Apr. 19, 2016

(54) INTELLIGENT MEMORY MANAGEMENT SYSTEM AND METHOD FOR VISUALIZATION OF INFORMATION

(71) Applicant: Invensys Systems, Inc., Foxboro, MA (US)

(72) Inventors: James McIntyre, San Jose, CA (US); Robert Hunter, Orange, CA (US)

(73) Assignee: Invensys Systems, Inc., Foxboro, MA (US)

( * ) Notice: Subject to any disclaimer, the term of this patent is extended or adjusted under 35 U.S.C. 154(b) by 125 days.

(21) Appl. No.: 13/665,554

(22) Filed: Oct. 31, 2012

(65) Prior Publication Data

US 2013/0120441 A1 May 16, 2013

Related U.S. Application Data

(60) Provisional application No. 61/553,745, filed on Oct. 31, 2011.

(51) Int. Cl.
*G09G 5/373* (2006.01)
*G09G 5/14* (2006.01)

(52) U.S. Cl.
CPC ..... *G09G 5/373* (2013.01); *G09G 5/14* (2013.01); *G09G 2340/045* (2013.01); *G09G 2340/0407* (2013.01); *G09G 2340/14* (2013.01); *G09G 2354/00* (2013.01)

(58) Field of Classification Search
CPC . G09G 5/373; G09G 5/14; G09G 2340/0407; G09G 2340/045; G09G 2340/14; G09G 2354/00
USPC ..... 345/419, 421, 422, 426, 427, 428
See application file for complete search history.

(56) References Cited

U.S. PATENT DOCUMENTS

| | | | |
|---|---|---|---|
| 5,353,400 | A | 10/1994 | Nigawara et al. |
| 5,526,268 | A | 6/1996 | Tkacs et al. |
| 5,812,394 | A | 9/1998 | Lewis et al. |
| 5,825,361 | A | 10/1998 | Rubin et al. |
| 5,923,307 | A | 7/1999 | Hogle, IV |
| 5,926,177 | A | 7/1999 | Hatanaka et al. |
| 6,075,530 | A | 6/2000 | Lucas et al. |
| 6,188,403 | B1 | 2/2001 | Sacerdoti et al. |
| 6,201,996 | B1 | 3/2001 | Crater et al. |
| 6,268,853 | B1 | 7/2001 | Hoskins et al. |
| 6,269,473 | B1 | 7/2001 | Freed et al. |
| 6,295,513 | B1 | 9/2001 | Thackston |
| 6,301,579 | B1 | 10/2001 | Becker |

(Continued)

OTHER PUBLICATIONS

Moller, "Speed-up Techniques for Real-Time Rendering", Lecture slides for Stanford University course CS 248—Introduction to Computer Graphics. Nov. 9, 2000.*

*Primary Examiner* — Xiao Wu
*Assistant Examiner* — Chong Wu
(74) *Attorney, Agent, or Firm* — Thomas J. Roth, Esq.

(57) ABSTRACT

A computer system and method removes or changes graphic content not discernable from the rendering tree stored in memory. The content modified depends on its redraw area in a physical monitor or a pane, which is contained within a layout in a frame. One or more frames are defined as part of a logical monitor. A physical monitor may have one or more logical monitors. Each redraw area is determined and graphic content is modified with different graphic having a memory use less than the original graphic that is determined not to be discernable based on the resolution and zoom information.

15 Claims, 12 Drawing Sheets

(56) References Cited

U.S. PATENT DOCUMENTS

| | | | | |
|---|---|---|---|---|
| 6,396,516 | B1 | 5/2002 | Beatty | |
| 6,571,133 | B1 | 5/2003 | Mandl et al. | |
| 6,784,902 | B1 | 8/2004 | Melder et al. | |
| 6,819,960 | B1 | 11/2004 | McKelvey et al. | |
| 6,854,111 | B1 | 2/2005 | Havner et al. | |
| 6,891,535 | B2 | 5/2005 | Perry et al. | |
| 7,076,311 | B2 | 7/2006 | Schuster | |
| 7,086,009 | B2 | 8/2006 | Resnick et al. | |
| 7,089,266 | B2 | 8/2006 | Stolte et al. | |
| 7,165,226 | B2 | 1/2007 | Thurner et al. | |
| 7,188,169 | B2 | 3/2007 | Buus et al. | |
| 7,337,030 | B2 | 2/2008 | Thomas et al. | |
| 7,480,709 | B2 | 1/2009 | Callaghan | |
| 7,515,977 | B2 | 4/2009 | Eryurek et al. | |
| 7,647,126 | B2 | 1/2010 | Blevins et al. | |
| 7,676,294 | B2 | 3/2010 | Baier et al. | |
| 7,680,546 | B2 | 3/2010 | Gilbert et al. | |
| 7,698,109 | B2 | 4/2010 | Binzer et al. | |
| 7,734,607 | B2 | 6/2010 | Grinstein et al. | |
| 7,783,370 | B2 | 8/2010 | Nixon et al. | |
| 7,969,432 | B2 | 6/2011 | Hall | |
| 8,027,859 | B2 | 9/2011 | Pulfer | |
| 8,055,375 | B2 | 11/2011 | Pingel et al. | |
| 8,065,658 | B1 | 11/2011 | Bali et al. | |
| 8,125,310 | B2 | 2/2012 | Enkerud et al. | |
| 8,185,219 | B2 | 5/2012 | Gilbert et al. | |
| 2002/0019672 | A1 | 2/2002 | Paunonen | |
| 2003/0122824 | A1* | 7/2003 | Chen et al. | 345/428 |
| 2004/0186927 | A1 | 9/2004 | Eryurek et al. | |
| 2005/0110789 | A1* | 5/2005 | Le Ouay | 345/419 |
| 2006/0069459 | A1 | 3/2006 | Retlich | |
| 2006/0229922 | A1 | 10/2006 | Levy et al. | |
| 2006/0267982 | A1* | 11/2006 | Aguera y Arcas | 345/428 |
| 2007/0008332 | A1 | 1/2007 | Smith | |
| 2007/0168065 | A1 | 7/2007 | Nixon et al. | |
| 2007/0179641 | A1 | 8/2007 | Lucas et al. | |
| 2007/0236498 | A1 | 10/2007 | Higuchi et al. | |
| 2007/0236499 | A1 | 10/2007 | Mihara et al. | |
| 2008/0062203 | A1 | 3/2008 | Williams | |
| 2009/0303253 | A1* | 12/2009 | Flake et al. | 345/660 |
| 2010/0017746 | A1 | 1/2010 | Husoy et al. | |
| 2010/0042376 | A1 | 2/2010 | Weatherhead | |
| 2010/0231588 | A1* | 9/2010 | Barczak | 345/422 |
| 2010/0268691 | A1 | 10/2010 | Grinstein et al. | |
| 2011/0050687 | A1* | 3/2011 | Alyshev et al. | 345/419 |
| 2011/0161054 | A1* | 6/2011 | Woolf et al. | 703/1 |
| 2011/0258568 | A1 | 10/2011 | Pandurangan et al. | |
| 2011/0289428 | A1* | 11/2011 | Yuen et al. | 715/752 |
| 2011/0306417 | A1* | 12/2011 | Sheblak et al. | 463/32 |
| 2012/0029661 | A1 | 2/2012 | Jones et al. | |
| 2012/0041570 | A1 | 2/2012 | Jones et al. | |

* cited by examiner

INTELLIGENT MEMORY MANAGEMENT SYSTEM AND METHOD FOR VISUALIZATION OF INFORMATION

BACKGROUND

Computer systems display information that includes graphic objects. An object is a definition of attributes manipulated by a software programming. A graphic object is a visual representation of a geometric shape or animation defined by the object. A graphic object can be a simple square filled with a pattern, to a complex graphic object displaying a pump detailing the housing, shaft, motor and impellers.

A complex graphic object is made up of simple graphic objects such as a point, a line, a curve or geometric sharp. A complex graphic object is also called a graphic element. A user selects from a library of simple graphic objects and graphic elements to build a visual representation of a pump, valve, motor or building. One or more graphic objects are displayed on a physical monitor using a software program. A physical monitor may be separated into one or more logical monitors. Logical monitors are sized and shaped to prevent overlap of graphic objects. U.S. Pat. No. 5,923,307 assigned to Microsoft Corporation titled "LOGICAL MONITOR CONFIGURATION IN A MULTIPLE MONITOR ENVIRONMENT" describes managing graphical content in virtual monitors using one or more physical monitors. A logical monitor is called a virtual monitor.

A typical computer 206 as shown in FIG. 2 includes a central processing unit, memory and disk hardware. The memory runs an operating system and application programs such as a runtime visualization application 102*a* or a client side visualization application 102*b*. The disk may contain a visualization configuration repository 202 and a visualization application 102. Computers are interconnected through a network 204. A typical network is a local area network operating on TCP/IP an industry messaging standard. A network may consist of one or more networks behind a firewall or the network is connected to a second network remote from the first network, the remote network is accessible using the internet. An application program or visualization configuration repository may be on the local area network or stored and accessible at the second network over the internet.

The operating system runs a graphic user interface ("GUI") and the application 102 displays information that communicates to the user. Typically the GUI operates on a desktop metaphor and the screen of the monitor or physical monitor is called a virtual desktop. The desktop monitor or physical monitor is typically a two dimensional template area but three dimensional areas are being more common. Referring to FIG. 5, the area supports graphic objects in one or more panes 108 within a layout 106*c*. A layout is assigned to a frame 104. A frame resides in the physical monitor area.

Each panel 108 may support a different application or program. In this case, the application may be a word processing program, human machine interface program, desktop publishing, CAD/CAM/CAE, among other applications. A user can display one or more part of the application in a pane. But the user may want more detail than a single physical monitor can display in a pane filling out a window or the maximum area of the monitor. To increase display area a second monitor is used. Referring to FIG. 3*b*, the user can split a physical monitor into two frames 208, 302 or include a second physical monitor. Each frame 104 can have an output of the application either delivered at the client side 208 or provided by server side 206, subdivide the output or display two different outputs of application. A frame may occupy 100% of the area of a physical monitor where a physical monitor can be one logical monitor 302. Referring to FIG. 4, the user can place the output of the application in all physical monitors 208 (multiple frames can be created in a single physical monitor). The user can move graphic objects between frames and between two physical monitors or two logical monitors, as shown in FIG. 3.

SUMMARY

In one embodiment, a system is disclosed for processing graphic objects and graphic elements to reduce memory use by substituting a first graphic content with a second graphic content, where the second graphic content is used having less memory demand depends whether the first graphic content is discernable in a window or pane of a window.

In another embodiment, a method for processing graphic objects and graphic elements or graphic content to reduce memory use by substituting a first graphic content with a second graphic content, where the second graphic content is used having less memory demand depends whether the first graphic content is discernable in a window or pane of a window.

The system and method determines available real estate dynamically for objects rendered in a target pane for the user interface presented to the user. The user can change the zoom factor of a pane or window, or modify the number of logical monitors within a physical monitor or modify the number of frames within a logical monitor, or the number of assigned layouts and panes can change therein, by user demand through the client viewer, or an application program constructed using the IDE.

The above embodiments are not limited by the figures and descriptions disclosed in this application.

DETAILED DESCRIPTION

A visualization system configured to display an industrial process visualization (e.g., a representation of an industrial process) based on one or more properties of a display is described herein. It is understood other visualization applications such as a desktop publishing system can benefit from the present disclosure described herein.

Figure 7:
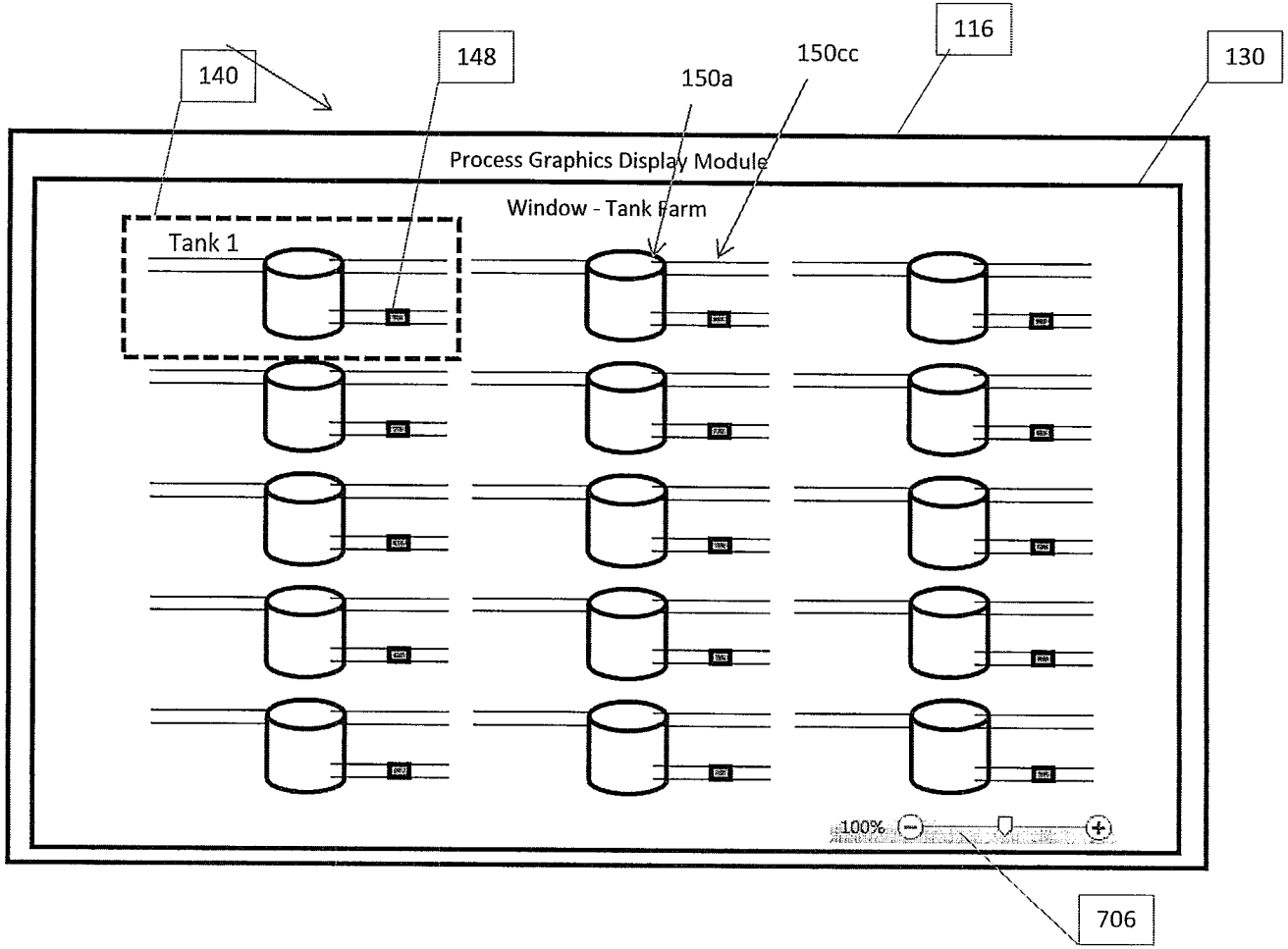
FIG. 7 is a window (FIG. 1) containing a tank farm for processing within the process graphics display module FIG. 1, FIG. 10) at zoom viewing percentage of 100%.

A visualization application is a software program that displays information in the form of graphic elements or graphic objects. The information displayed may be a tank farm as shown in FIG. 7 or more detailed (or zoomed) image of the tank farm, at Tank 1 of FIG. 8. The information is displayed in a window. A window can have one or more frames, and each frame has one or more layouts with defined attributes (e.g. size and resolution) that defines a windowed area of a ViewApplication. A ViewApplication can be built using an Integrated Development Environment ("IDE"). The IDE consists of various configuration editors to configure a system. An example of an IDE development tool is the Invensys ArchestraA product for modeling industrial process systems.

Figure 2:
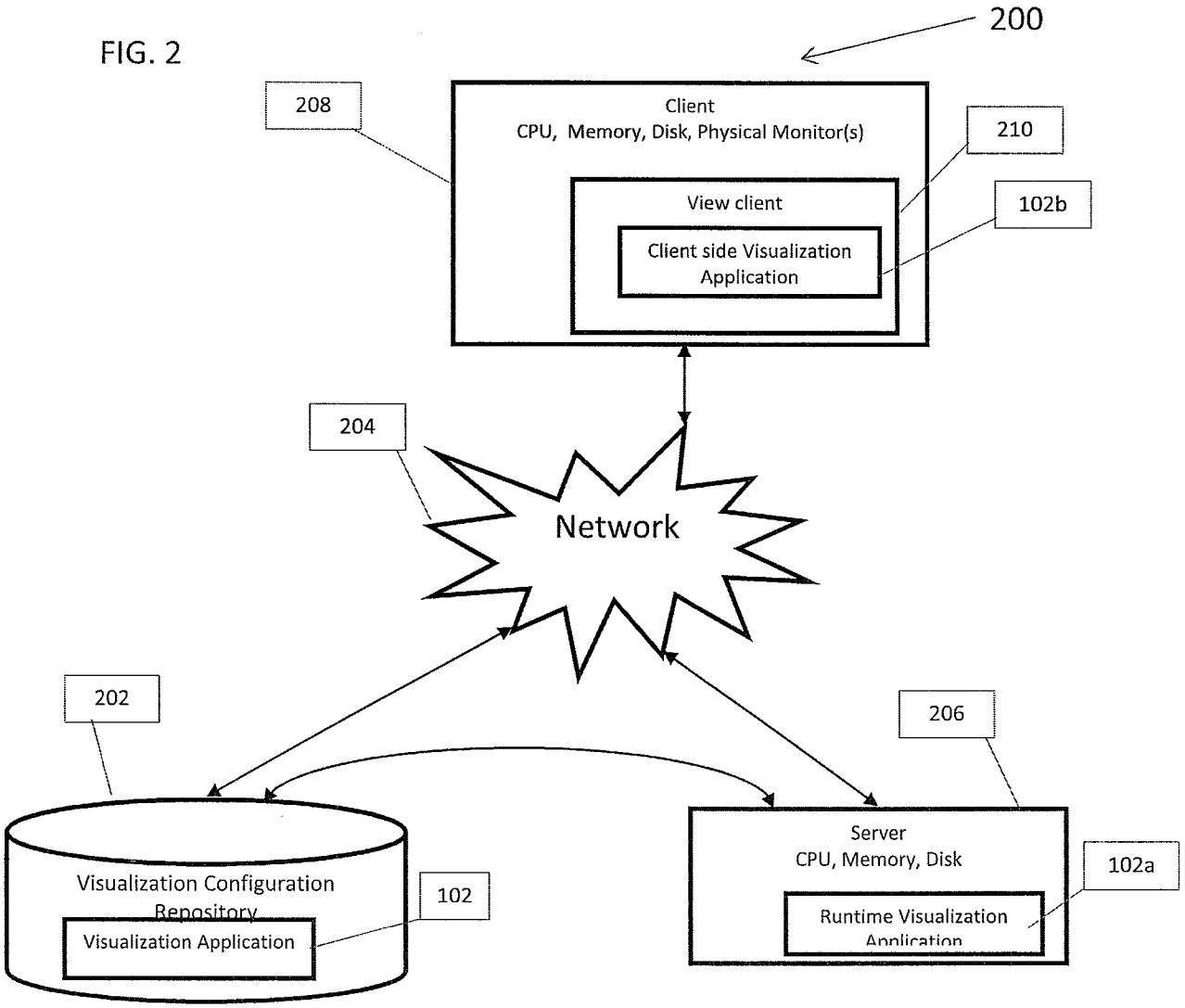
FIG. 2 is a schematic diagram of the runtime implementation of the Visualization application accessed by a View Client over a network from server side application; the visualization application is maintained in a visualization configuration repository.

FIG. 7 shows a customized display of user information, in this example, a Tank Farm 130. A Tank Farm 130 is an industrial application of tanks or storage units. Tank 1 140 may hold a material used to make a product. The zoom factor for the Window is 100%. At this zoom factor the Runtime Visualization Application 102*a* operating on a computer 206 displays the graphic content, as shown in FIG. 7. Referring to FIG. 2, a View Client 210 operating a client side visualization application 102*b* on a second computer 208 allows the user view the tank farm 130. The user can construct and modify the graphic content displayed by the Visualization Application 102 through a Visualization Configuration Repository 202. The visualization application 102 is compiled into executable form creating a runtime visualization application 102*a* that the user at the view client 210 can employ on their computer 208 to manipulate and view graphic content such as FIGS. 7-9 according to FIGS. 3-6.

Figure 1:
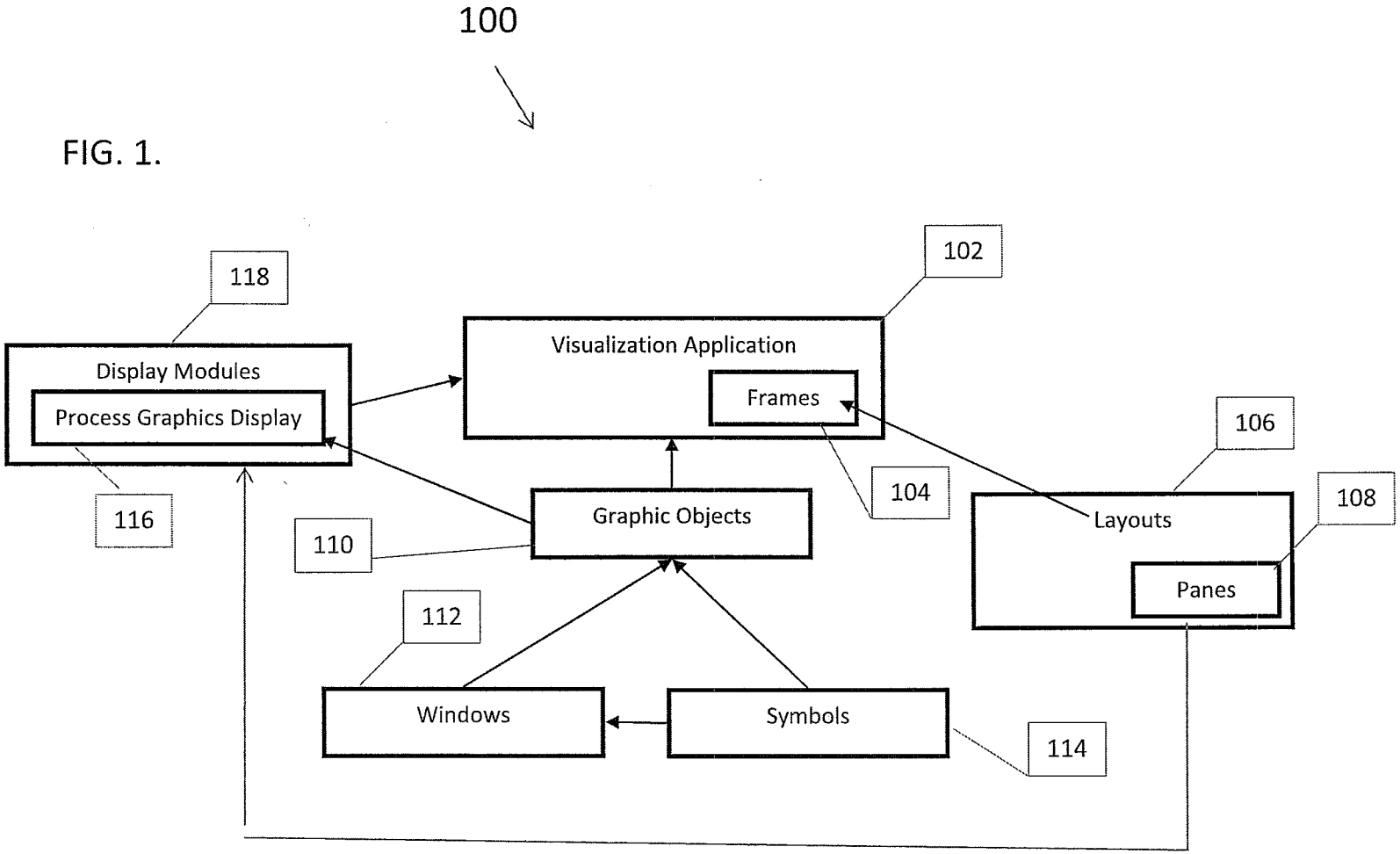
FIG. 1 is a schematic diagram of the visualization memory management system presenting graphic elements or graphic objects in a visualization application presenting information visually to a user.
Figure 6:
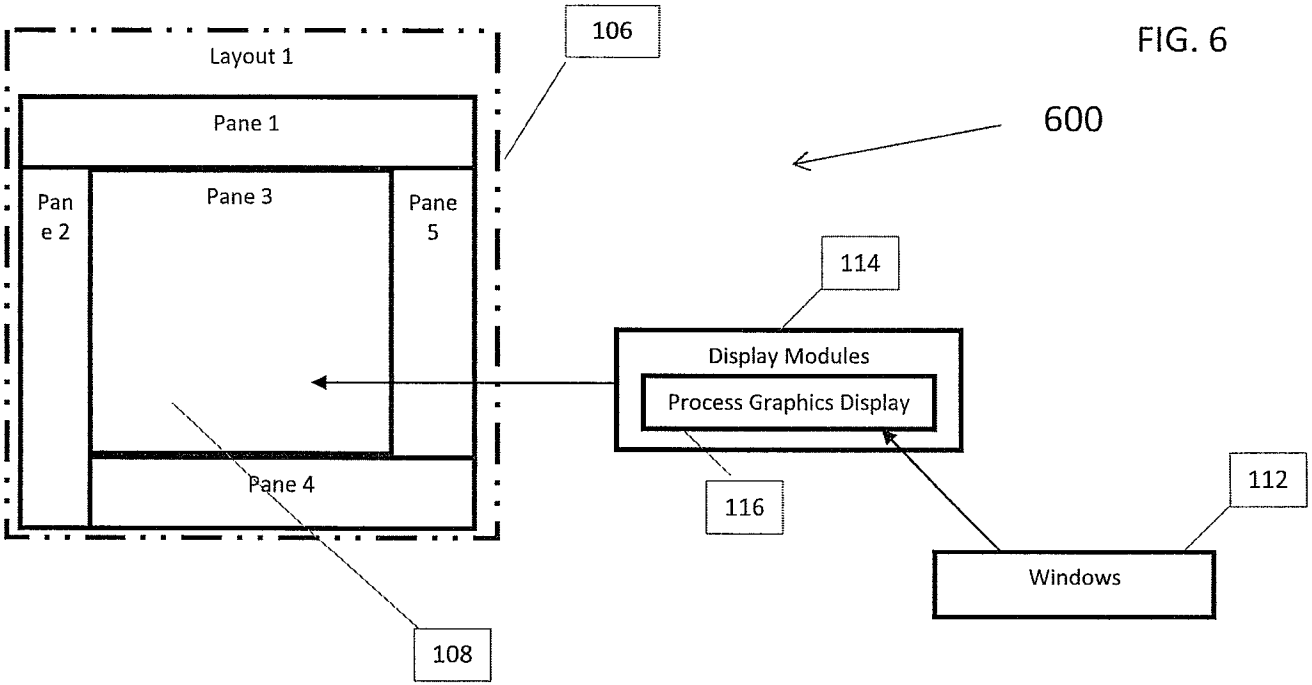
FIG. 6 illustrates a window such as shown in FIG. 7 processed into a pane of a layout within a frame; the window graphic content is processed by a Process Graphics Display Module according to FIG. 10.
Figure 8:
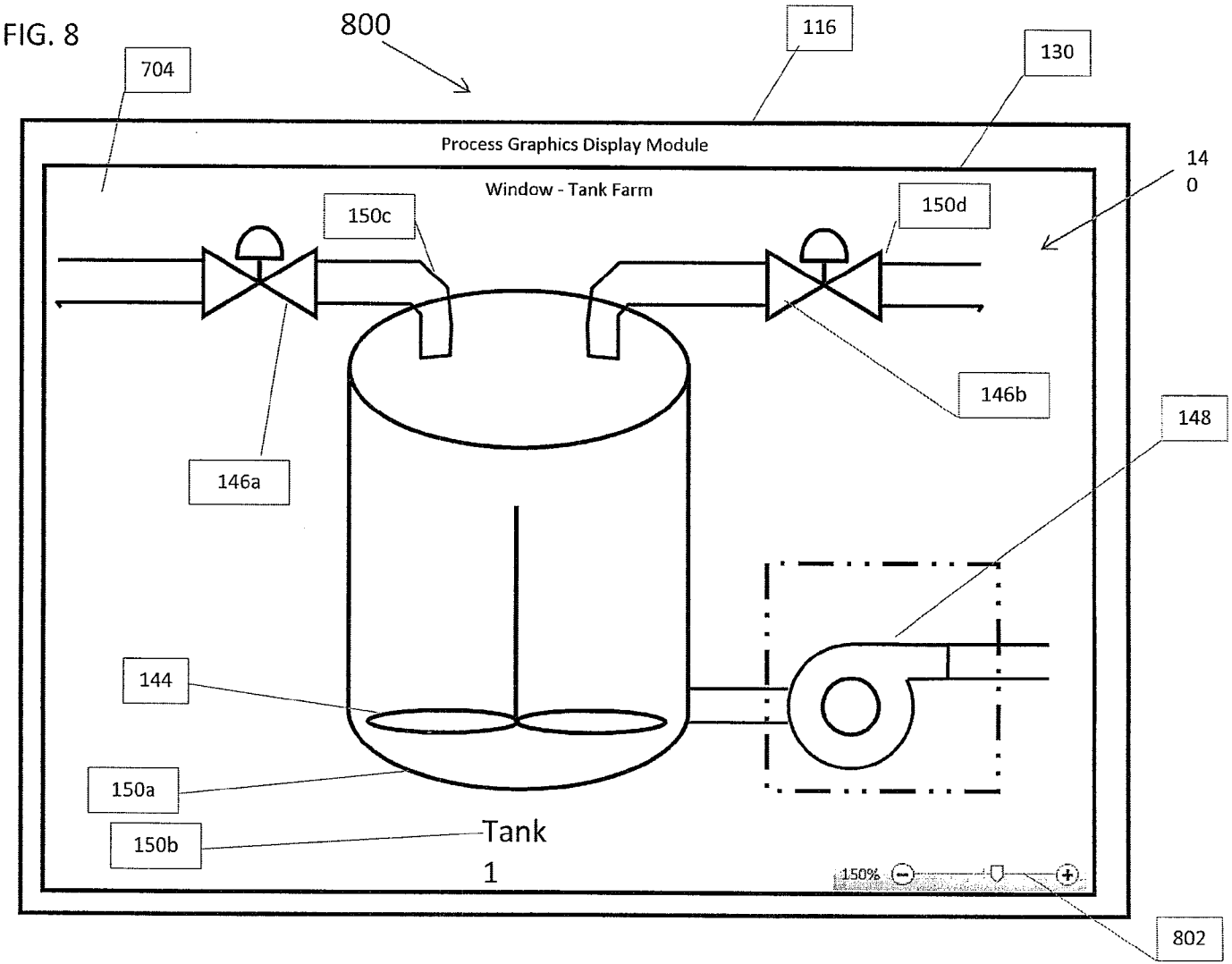
FIG. 8 is a 50% zoom factor of Tank 1 of the Tank Farm of FIG. 9.

A user interacts with the visualization application 102 using client side visualization application 102*b* at the view client 210, at FIG. 2. In one example, the user loads a tank farm window 112, 130 that displays a grouping of tanks, Tank 1 140 at FIG. 7. The tank farm window 130 corresponds to one of the windows 112 at FIG. 1. Referring to FIG. 8, Tank 1 140 includes additional detail such as a set of valves (146*a*, 146*b*), and piping (150*c*, 150*d*) through which material flows from another tank under the action of a pump 148. Tank 1 140 may have an agitator 144 to mix material. The pump 148 is shown in outline form in one embodiment of the present invention, but a pump may contain detail showing housing texture, bolt size or contours. The tank farm is at 100% Zoom or normal mode after the user loads the tank farm graphic into the display area (e.g. physical monitor, virtual monitor, frame or pane). The user zooms to 150% in FIG. 8 to view more detail associated with Tank 1 140 of FIG. 7. As shown at FIG. 1 and FIG. 6 the window 112, 130 is processed through a Process Graphics Display Module 116. The Process Graphics Display Module or PDGM 116 is one of many software components of a Display Module 118.

Referring to FIGS. 1, 2, and 6-9, the tank farm window 130 is called from the View Client 210 by a user through the client side visualization application 120*b*. The user may request the tank farm window 112, 130 into a pane 108. The call is processed through the PDGM 116 as part of the Display Module 114. The PDGM processes the graphic content associated with the tank farm window according to FIG. 10. The discernable graphic content is displayed in view area (e.g. panel or monitor) and the graphic content not discernable is replaced with an object using less memory. For example, the pump symbol 148 is drawn as a filled in rectangle at FIG. 7. After zooming in the pump symbol 148 is displayed with more detail such as text 154*c* and flow arrows 154*b*, 154*a* at FIGS. 8 and 9. The PDGM displayed the additional graphic content after determining the display area and accompanying memory could support the detail.

Figure 9:
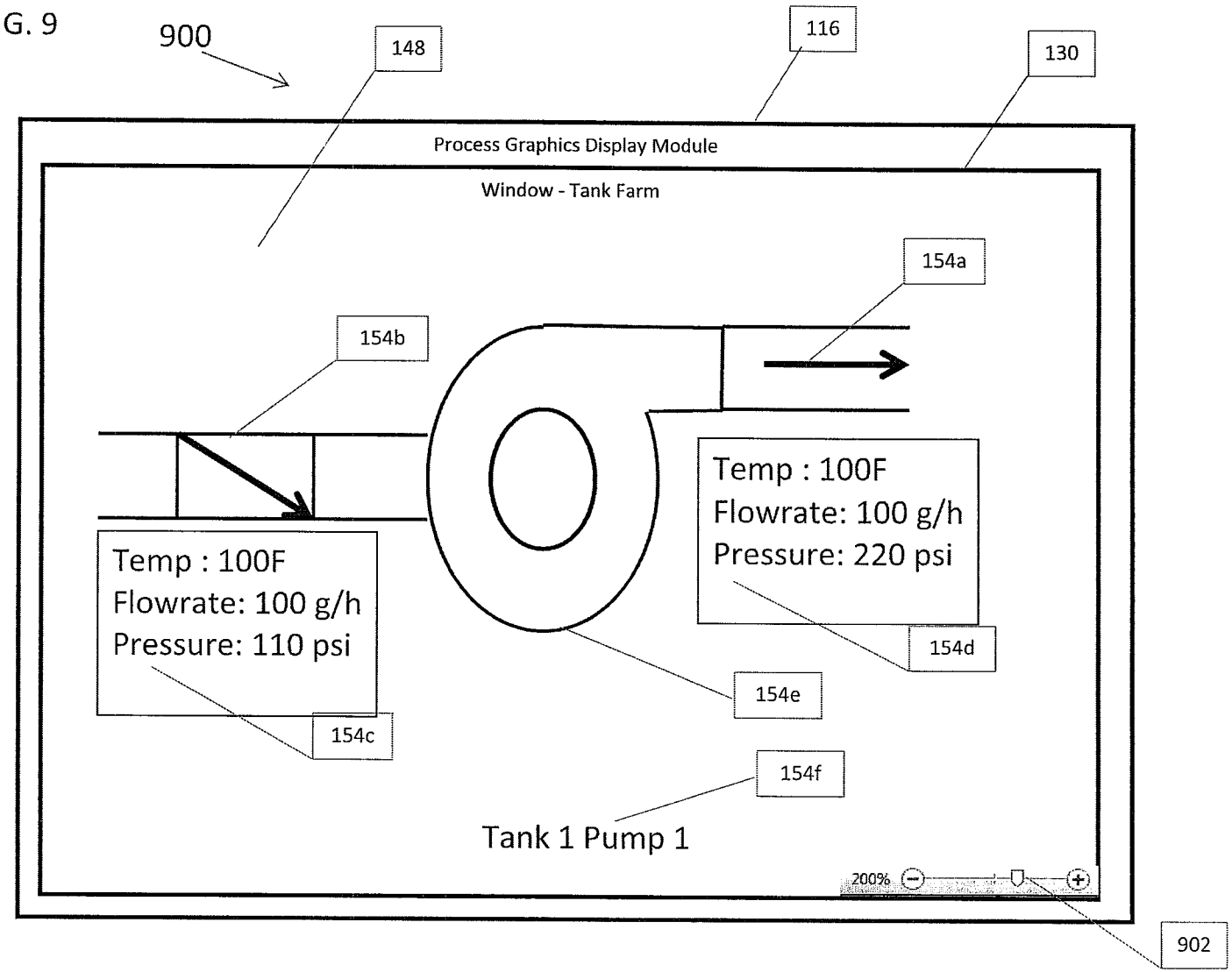
FIG. 9 is a 100% or 2× factor of Tank Farm at Tank 1 illustrating Pump 1.

Referring to FIG. 1, symbols 114 are defined as a graphic content that is a collection of graphical elements and other symbols 114 each with their distinct animation, which are grouped together to represent some aspect of a display, image or visual application. Symbols 114 cannot be opened by the user directly but must be first placed into a display. Symbols 114 are placed into one or more windows 112 or symbols are used by graphic objects 110. A graphic object 110 may be an association of symbols and other graphic objects 110 or a collection of symbols 114 in window 112 saved as a graphic object 110. For example, the arrows 154*a*, 154*b* in FIG. 9 are symbols. The arrow symbols may be added to a pump graphic object 154*e* to form a graphic object 110. Or additional symbols 114 such as graphic text 154*c*, 154*d*, 154*f* may be added to the pump 154 and arrows 154*a*, 154*b* and placed into a window 112 and saved as a graphic object 110 at FIG. 1, or Graphic Objects 110 and Symbols 114 are combined to create a Window 112 such as Tank Farm Window 130 of FIG. 7.

The visualization application 102 displays information in one or more display regions (e.g. frame, pane, monitor) using a graphical device interface. The interface lies between the visualization application and a graphics device driver (the "PDGM"). The PDGM may be located at the interface, or part of another application including the visualization application 102. A visualization application 102 is a program that may be a human machine interface, CDA/CAM/CAE, desktop publishing system or created by ArchestrA using its IDE tool. A visualization application 102 is defined broadly and includes any program that displays graphic content to a monitor 208*a* or display device between the operating system and use interface of the application running the graphic content for display to the user. Graphic content is not limited to a symbol 114, or graphic objects 110 such as a pump symbol 148. Graphic content is broadly defined to include any information displayed to the user. The information can be a simple line defined by length, thickness, color or shape, to a complex pump symbol 148 shown at FIG. 9.

Figure 5:
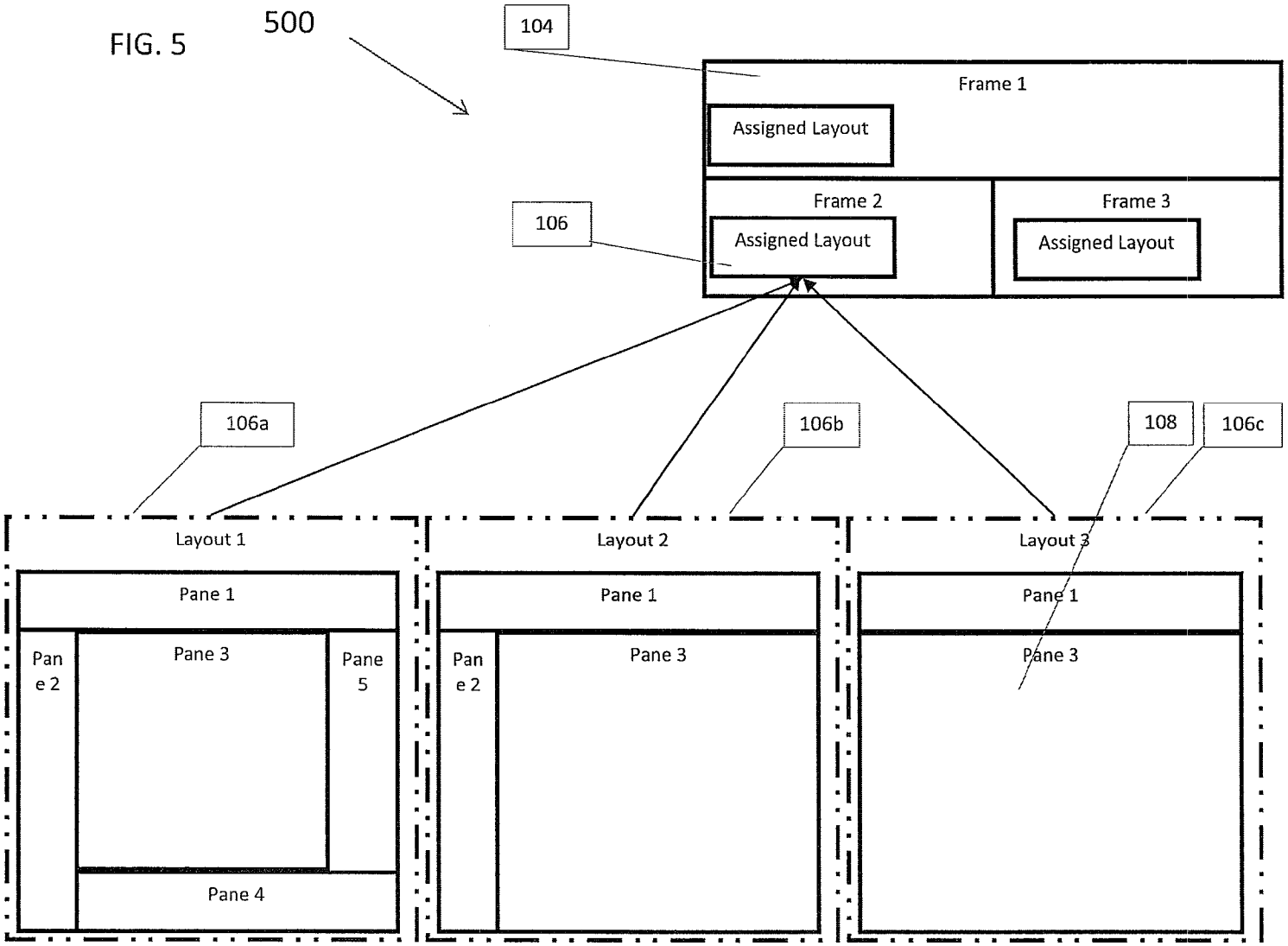
FIG. 5 is a block diagram of an exemplary frame of FIG. 4, consisting of an assigned layout showing various layout examples 1, 2, or 3 with exemplary pane breakouts within a layout.

Referring to FIG. 5, the frame 104 has one or more layouts 106 and each layout can have one or more panes 108. Referring to FIG. 1, the visualization application 102 can have one or more frames 104. Each frame has one or more layouts 106 and a layout 106 includes one or more panes 108. Graphic content includes symbols 114, graphics objects 110, graphical elements for text 142, graphical elements for symbols 150 such as tank objects includes a tank outline or line, a pipe and text. Graphic content further includes, but is not limited to, various symbols such as a pump symbol 148, valve symbol 146 and agitator symbol 144 which when combined can form a tank symbol 140. The tank symbols 140 form a tank farm placed in a window 130, 112. The window 112 may add symbols 114 to form graphic objects 110.

Figure 10:
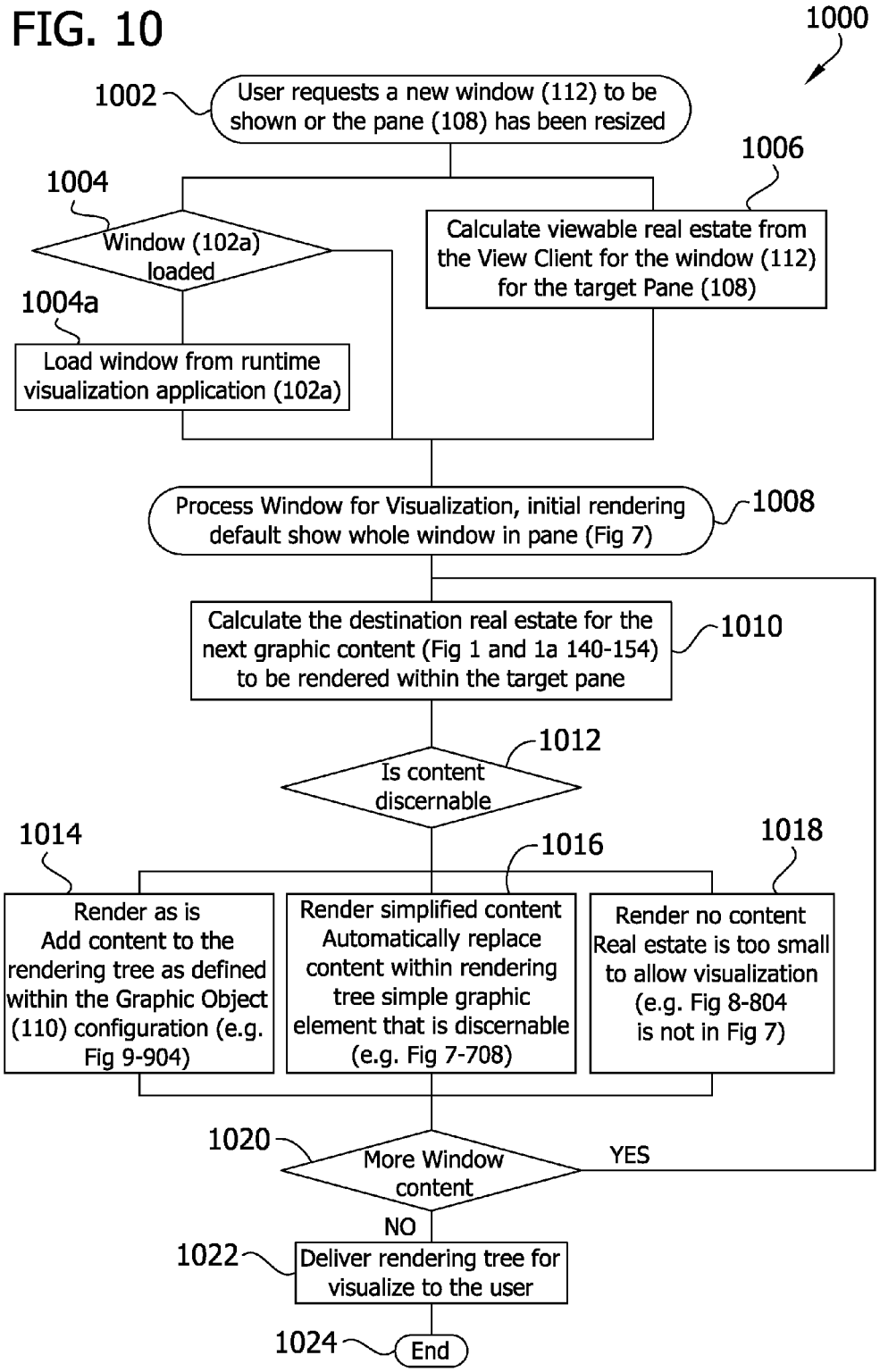
FIG. 10 is a flow chart illustrating the embodiments of the invention.

The window 112, 130 is processed through a Process Graphics Display Module 116 more fully described in FIG. 10 as discussed herein. The PDGM is part of Display Modules 118. The PDGM 116 processes the graphic content stored in a database structure generally called a rendering tree. As explained below, the PDGM substitutes a second graphic content having less memory demand than a first graphic content as a function of the zoom factor, physical monitor resolution, display screen aspect ratio and the number of panes across the monitors of a virtual monitor, or any combination of thereof, where a virtual monitor can includes one or more physical monitors.

The PDGM 116 may reside with the graphics driver, as part of the application or somewhere between the operating system and application. The PDGM 116 renders the first graphic with the second graphic having a smaller memory the rendering of the second graphic depends on a change in zoom factor, a change in monitor resolution, or adding or removing panels. The use of the second graphic reduces processing time and system resources upon redraw of highly detailed graphics, such as the tank farm at FIG. 7 as shown in the detail of FIGS. 8 and 9 that would be otherwise redrawn or rendered even if the graphic content is not discernable, as described in FIG. 10.

Referring to FIG. 1 b described in part above, illustrates building a window 112 shown in more detail as a tank farm 130 at FIG. 7. A user builds the tank farm window 130 using a GUI associated with the visualization application 120. Referring to FIG. 2, the application 102 is associated with a visualization configuration repository 202. The user builds the tank farm 130 using the graphical elements 150, 152 and 154. The graphical elements build symbols 148, 146, or symbols 144 may be provided separately. The user builds the tank symbol 140 from the graphical elements and symbols. The user builds the tank farm window 130 from the tank symbols 140 and graphical elements for text 142 associated with the tank symbols used to build the tank farm. Alternatively the user may build the tank farm window 130 with the IDE provided with the ArchestrA software from the assignee Invensys Systems, Inc of the present invention.

Referring again to FIG. 2, a computer system is shown that implements one embodiment of the present invention. The client computer 208 hosts the client side visualization application 102*b* that the user accesses in the view client 210. The user can access the runtime version of the visualization application 102*a* located at the server computer 206. The access can be over the local area network located within the same gateway protected by the same firewall. The access can be over the internet (e.g. a public network outside the firewall) to a second network hosting the server computer system 201 having the runtime visualization application 102*a*. The application 102 is built with the visualization configuration repository 202 using the graphic content described above in the discussion of FIG. 1*b*.

Figure 3:
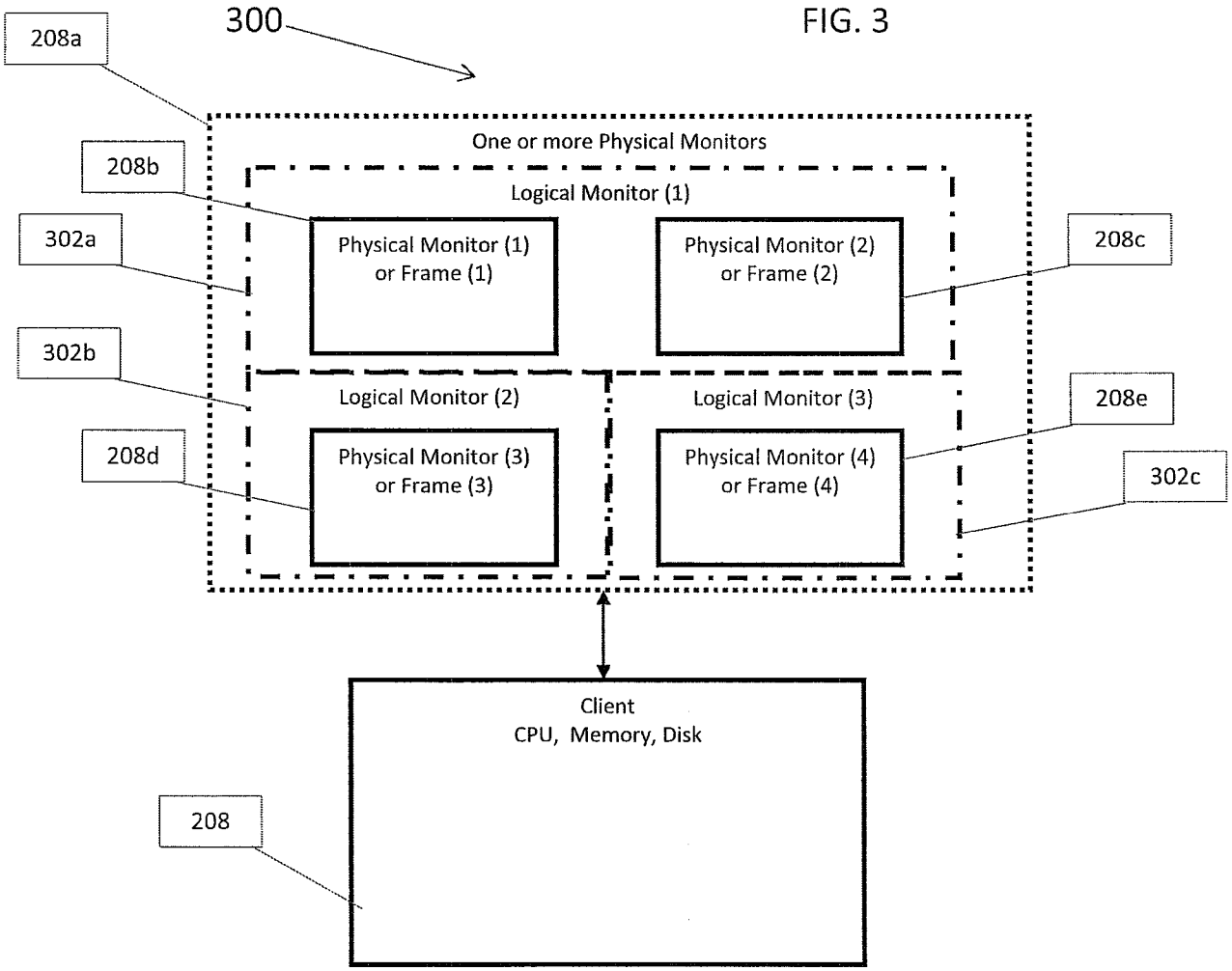
FIG. 3 is a block diagram of a physical monitor with one or more logical monitors as implemented by a computer system as described in the prior art.
Figure 3B:
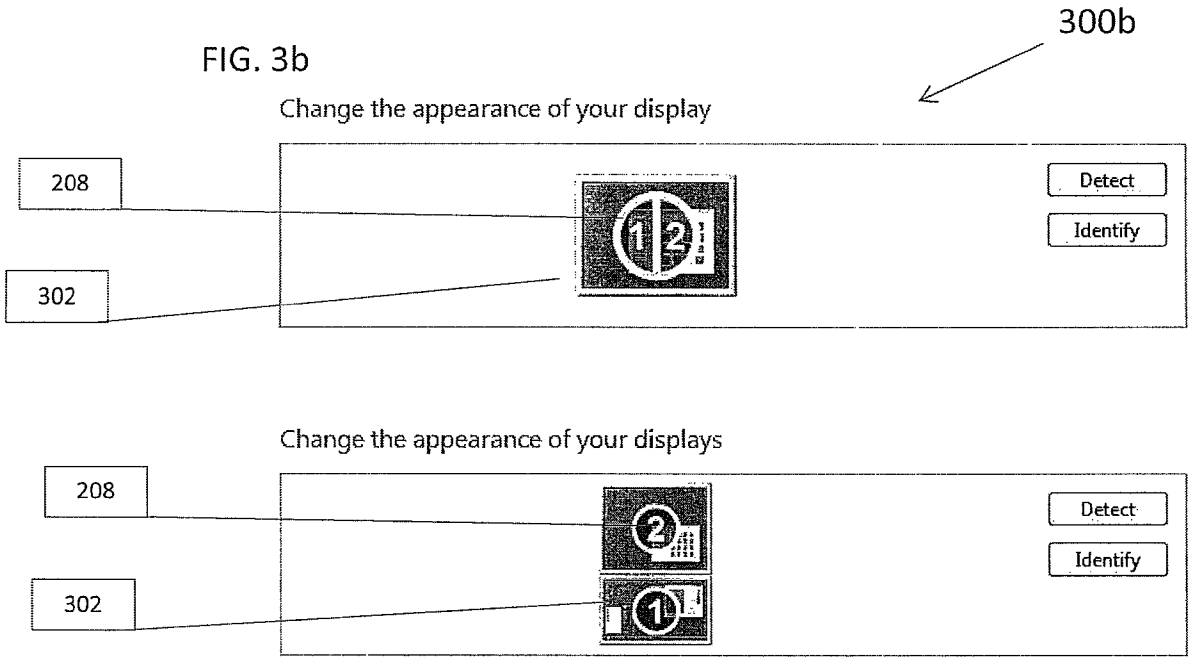
FIG. 3*b* is an illustration of changing the appearance of a physical monitor into two logical monitors as described in the prior art.

Referring to FIG. 3, the client computer system 208 can run the application 102*b* in one or more physical monitors 208*a*. The display content such as the tank farm window 130 is operated in one physical monitor defined as one virtual monitor or logical monitor space. The PDGM 116 processes display content before rendering the graphic content in the physical monitor 208*a*, at a logical monitor 302*a*, 302*b*, 302*c*, or at the physical monitor or frame 208*b*, 208*c*, 208*d* ,208*e* all within the physical monitor 208*a*.

Figure 4:
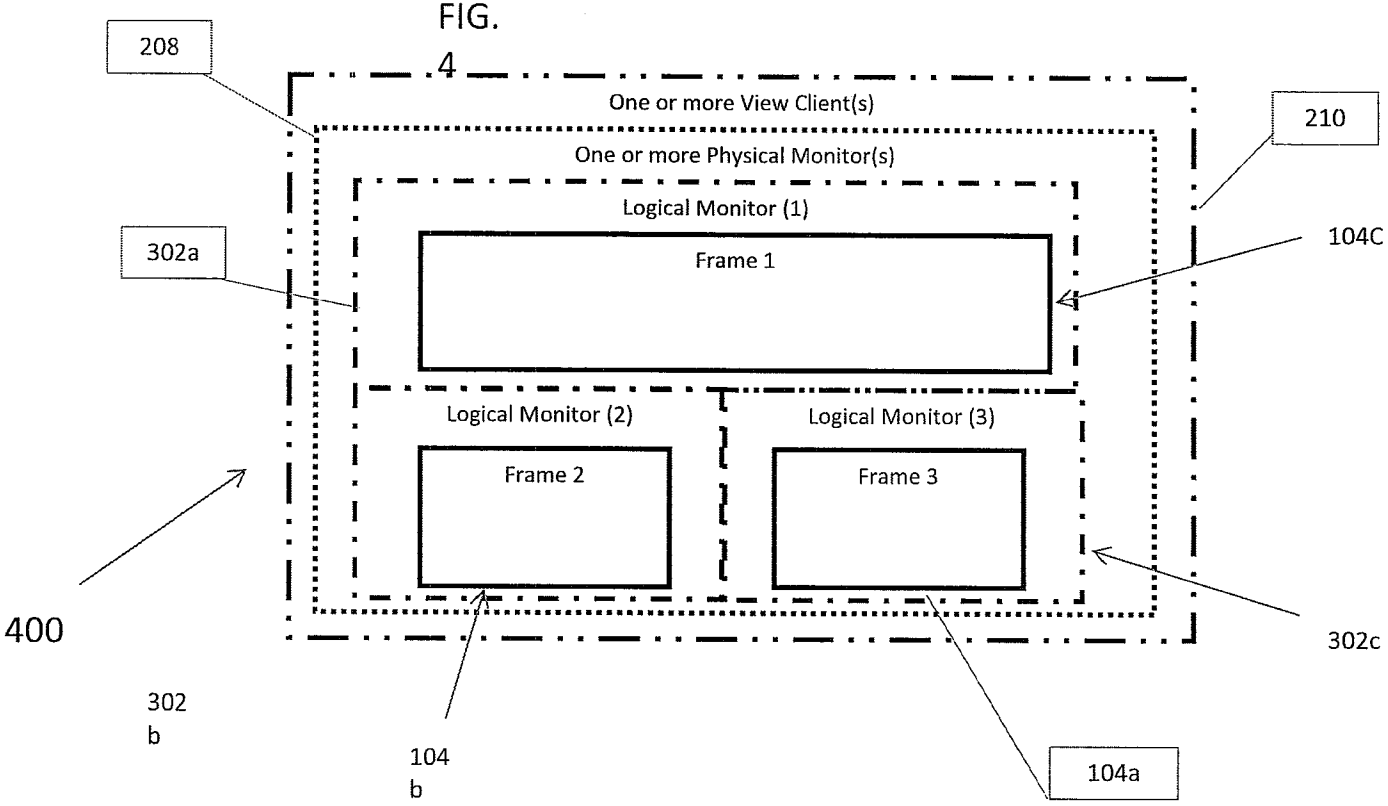
FIG. 4 is an illustration of one or more view clients viewing one or more physical monitors divided into one or more logical monitors and each logical monitor has a frame of graphic objects or elements.

Referring to FIG. 4, one or more view clients 210 can access the viewing configuration as created by the user accordingly defined in FIG. 3. The user may build another viewing configuration as defined by the physical monitors 208 with one or more logical monitors 302*a*, 302*b*, 302*c*, with frames 104*a*, 104*b*, 104*c*. Each frame may have the tank farm window 130 or another window with graphic content build by the user in the application 102.

The PDGM 116 of the present disclosure reduces memory needs of the redrawn graphic content (as described herein) even if the graphic content is present in one or more panes, or zoomed at different levels in one or more panes or frames. Copying the view configuration may create a substantial drain on the resources of the computer system without the PDGM of the present disclosure. Typically, hardware resources typically remain constant, and operating the multiple view clients changing monitor resolution, adding and deleting panes, or zooming in or out requires redrawing of all the copied graphic content. Thus, without the PDGM, system performance is decreased substantially as the view client copies increase and redraw the graphic content even if the graphic content is not discernable.

Referring to FIG. 5, the frame 104 is further defined with assigned layouts 106. A layout 106*a* can be arranged in various panes as shown in layout 2 106*b* and layout 3 106*c*. Each pane can have a window 112 defined by the user programming the application 102.

Referring to FIG. 6, the window 112 as defined in FIG. 7, the tank farm window 130 is processed through the PDGM 116, part of the display modules 114, and rendered into the pane 108.

Referring to FIGS. 7, 8 and 9, the tank farm window is discussed in relation to the PDGM, and the tank farm window is an exemplary graphic result of one of many visualization applications that can use the PDGM 116.

Referring to FIG. 7, the Tank Farm 130 is processed through the Process Graphics Display Module 116. Tank 1 140 displays text graphic Tank 1 150 after processing by the PDGM. Tank 1 outline 150*a* is shown as well, at 100% zoom factor 706 for this graphic content mix at FIG. 7. The Tank 1 Pump 1 148 is shown as a filled in rectangle. The PGDM determined that not all of Pump 1 148 graphics were not discernable at a 100% zoom factor 706. But at a 150% zoom factor 802 Pump 1 148 graphic content is shown in more detail but less detail than at a 200% zoom factor 902. At a 200% zoom factor 902 the PGDM determined (according to FIG. 10), that all the graphic content is revealed in the pane, frame or window, as selected by the user on the virtual desktop monitor. FIGS. 3 and 4 show possible view configurations selected by the user from the Client Side Visualization Application 102*b* from the View Client 210, at one or more View Clients 210 as shown in the system view configuration at 400.

The amount of graphic content discernable is a function of screen resolution, zoom factor, size of virtual monitor, and view configuration (as described above) set by the user in one or more view clients 210. The PDGM is agonistic to the window graphic content. The window graphic content memory use is combined with the above factors as part of the PDGM logic to determine discernable graphic content. For example, comparing FIG. 8 pipe outline 150*c* with FIG. 7 pipe outline 150*cc*, the contours of the pipe in FIG. 8 are not discernable in FIG. 7 rendered graphic content after processing through the PDGM. FIG. 7 zoom factor 706 is 100%. FIG. 8 zoom factor 802 is 150%. Depending on the view configuration, a 50% increase in zoom factor may or may not show the contours of the pip 150*c*. The view configuration is the graphic content detail or amount of memory for the graphic content, the screen resolution, zoom factor, size of virtual monitor and number of panes and view clients active. If more than one view client 210 is active the memory available drops on the same hardware, and reduced memory availability translates into less discernable content determined by the PDGM. Other techniques such as caching to disk memory storage can be used but this swapping in and out of disk memory slows system performance. The swapping or substituting a first graphic content with a second graphic content having less memory demand is more efficient, a better use of available memory, and faster than disk swapping. The second graphic can be Tank 1 140 at FIG. 7 and the first graphic can be Tank 1 704 at FIG. 8. Alternatively, a first graphic 148 at FIG. 8 is swapped by PDGM with the second graphic 148 at FIG. 9, when rendering the Tank Farm Window 130 after processing by the PDGM in the user selected view configuration.

Figure 1B:
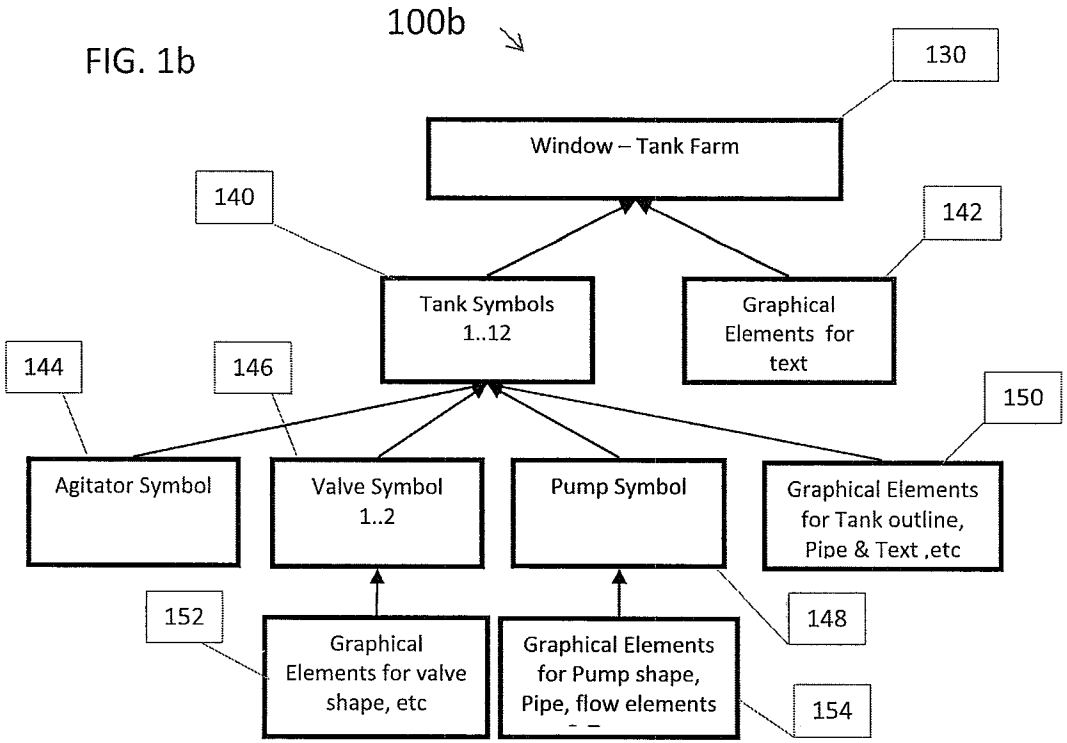
FIG. 1*b* is a block diagram of graphic content that makes up the tank farm of FIG. 9 in a window using the Visualization Application of FIG. 1.

Referring to FIG. 8, the zoom factor 706 is increased 50% to zoom factor 802. Assuming the view configuration and hardware system remain constant, the PDGM 116 rendered additional graphic content according to FIG. 10. FIG. 8 zoomed into Tank 1 and the PDGM 116 displayed an agitator 144 not previously rendered or displayed in FIG. 7. The agitator 144 was made part of the tank farm window 130 graphic content when created in the visualization application 102 using the visualization configuration repository 202, at FIG. 2. The agitator symbol 144 is part of the graphic content of FIG. 1*b*. The user employed the agitator symbol 144 as shown at FIG. 1*b* as part of the Tank Symbol 140 and then made part of the Tank Farm Window 130. One embodiment of the present invention is not limited to the graphic content shown at FIG. 1*b*. The user can employ the IDE tool of ArchestrA to build symbols representing other real life devices, or import symbols and graphic content developed in other applications such as CAD/CAD/CAE software. This graphic content is subject to the PDGM 116 because the PDGM resides independent of the view client 210, or visualization application 102. The PDGM is position or logically joined to process the graphic content of a window 112 through the logic of FIG. 10 before the graphic content of the window 112 is rendered or displayed to the user at the view client 210. The user may be located at the server application 102*a* and the PDGM provides the same processing logic to determine discernable content before rendering.

Referring to FIG. 8, it represents Tank 1 140 after the user increases to zoom factor 802. Additional graphic content discernable is the valves 146*a*, 146*b*, the pipe contour 150*c*, the agitator 144, and Pump 1 148 in outline form. Referring to FIG. 7, the Pump 148 is the filled in rectangle 148 that uses less memory at the zoom factor 100% 706. The valves 146*a*, 146*b* are not shown as is other graphic content. Referring to FIG. 9 at the zoom factor 200% 902, the Tank Farm Window does not display Tank 1 150*a*, its valves 146*a*, 146, the agitator 144, the Tank 1 graphical text 150*b* because the PDGM remove this graphic content, instead of substituting, as the tank graphic content is not discernable. The PDGM added more graphic content such as the flow arrows 154*a*, 154*b*, and the pump text graphics at 154*c*, 154*d*, and 154*f*.

Referring to FIG. 10 the PDGM method and system is described as part of the remaining figures in the present disclosure. The PDGM method and system is generally shown at 1000. Steps 1002 through 1024 describe the operation of the Process Display Graphics Module 116 to determine discernable graphic content before passing the graphic content to a rendering data structure for display. Rendering data structures and its operation is well known in the prior art, and this technique may be part of the Display Modules 118.

At step 1002 the user may request a new window 112 or existing window 112*a* (not shown) or a pane 108 to be resized. Like numerals correspond to elements found at the figures disclosed in the present disclosure. The user selects a new or existing window 112, and the process proceeds to step 1004 where the window is loaded into the runtime visualization application 102*a* at step 1004*a*, or is an existing window 112*a* processed at step 1008. It is assumed the window 112 is initially rendered in the pane, the window 112 as rendered is shown at FIG. 7, the Tank Farm Window 130.

Returning to step 1002, the user may select a pane to be resized. At step 1006, the PDGM 116 determines viewable real estate at the View Client 210 for the window 112 for the target pane 108. The target pane may be a pane 108 shown (but not numbered) at FIG. 5 at Layouts 1, 2, and 3 indicated by reference numerals 106*a*, 106*b* and 106*c*, respectively. The number of panes and orientation of a pane 108 within a layout 106 is not restricted to the layouts 106 shown at FIG. 5. As shown in FIG. 5 a layout 106 is assigned to a Frame 104, and a Frame is assigned to the Logical Monitor 104 as part of the physical monitors 208 within one or more View Client 210. Thus, the PDGM 116 is capable of determining the graphic content associated with the pane that is selected by the user, and the PDGM determines the real estate for the selected pane 108 as the starting point to determine discernable graphic content to display upon resizing of the pane 108 at step 1006. Entering step 1008 from step 1004*a* or 1006, at step 1008, the window 112 for visualization 102 is defaulted to the whole window 112 in the panel 108. For example, the Tank Farm Window 103 is placed fully into the selected pane 108. At step 1010 the destination real estate is determined for the next graphic content (content is at FIGS. 7-9) to be rendered within the target pane 108. At step 1012 the PDGM 116 determines if the graphic content is discernable. This is determined based on the available real estate of the monitor, the zoom factor, and monitor resolution. The graphic content was defined by the user through the application 102 using the configuration repository 202, as described above.

The graphic content is stored in the data structure associated with the rendering tree. The rendering tree is populated by the application selecting the graphic content and a Display Module associated with the rendering operation, which may be part of the device driver, or user graphical interface. The discernable content is determined at steps 1014 or 1016 or 1018. If the graphic content memory use is such that is can fit within the available real estate, the graphic content is added to the rendering tree at step 1014, and the graphic content is rendered "AS IS". Next, if the graphic content cannot fit within the available real estate, step 1016 determines if it can substitute the second graphic with the first graphic to the rendering tree. The first graphic is a simplified graphic as compared with the second graphic. The first graphic uses less memory at the use selected, resized pane. Last, at step 1018 the real estate determined is too small to allow the simplest graphic to be visible. The graphic content is not placed onto the rendering tree for delivery to the display of the View Client 202. After step 1014, or 1016 or 1018, the PDGM checks for more Window 112 content at step 1020, and if more window content is available, the PDGM returns to step 1010 to determine available real estate for the next graphic content. At step 1020, after the graphic content available for displaying is processed, the PDGM at step 1022 delivers the rendering tree for visualization to another module of the Display Modules 118. After the graphic content is delivered at step 1022, the PDGM 116 ends at step 1024.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A method for visualizing graphical content in an industrial process visualization comprising:

determining available destination real estate of a portion of a target pane of a client viewer of the industrial process visualization for rendering a first graphic content representative of at least a portion of an industrial process as a graphic object, wherein the target pane comprises an area of a display that is visible to a user of the industrial process visualization and wherein said portion of the target pane is located entirely within the target pane and includes no graphic content other than the first graphic content for rendering therein such that the first graphic content is visibly rendered on the display when rendered as a graphic object within said portion of the target pane;

determining, based at least in part on the determined available destination real estate and one or more properties of the client viewer, whether the first graphic content when visibly rendered on the display as a first graphic object within said portion of the target pane is discernable by the user of the industrial process visualization; and populating a data structure associated with a rendering tree with one of (i) the first graphic object if it is determined that the first graphic content is discernable by the user when visibly rendered on the display as the first graphic object within said portion of the target pane, and (ii) a second graphic object if it is determined that the first graphic content is not discernable by the user when visibly rendered on the display as the first graphic object within said portion of the target pane, wherein the second graphic object is a simplified rendering of the first graphic content and is discernable by the user when visibly rendered on the display within said portion of the target pane; wherein when the data structure is populated with said one of the first and second graphic objects the other of the first and second graphic objects is excluded from the data structure so that the industrial process visualization does not render said other of the first and second graphic objects.

2. The method of claim 1, wherein the first graphic object uses more memory than the second graphic object.

3. The method of claim 2, wherein said one or more properties of the client viewer includes a zoom factor.

4. The method of claim 1, further comprising:

after said populating a data structure, determining available destination real estate within the target pane of the client viewer for rendering a second graphic content;

determining if the second graphic content is discernable by the user when rendered as a third graphic object within the target pane based on one or more properties of the client viewer; and populating the data structure with one of the third graphic object if the second graphic content is discernable by the user when rendered as the third graphic object within the target pane, and a fourth graphic object if the second graphic content is not discernable by the user when rendered as the third graphic object within the target pane, wherein the fourth graphic object is a simplified rendering of the second graphic content and is discernable by the user within the target pane.

5. The method of claim 1, further comprising receiving one of a request for a new window and a request to resize the pane before said determining available destination real estate.

6. The method of claim 1, further comprising:

determining, based at least in part on one or more properties of the client viewer, whether the first graphic content when rendered as the second graphic object within the target pane is discernable by user; and omitting the first graphic content from the data structure if it is determined that the first graphic content when rendered as the second graphic object within the target pane is not discernable by user.

7. The system of claim 1, wherein whether the first graphic content when rendered as a first graphic object within the target pane is discernable by the user is determined based at least in part on a monitor resolution.

8. The system of claim 1, wherein whether the first graphic content when rendered as a first graphic object within the target pane is discernable by the user is determined based at least in part on a size of a virtual monitor.

9. The system of claim 1, wherein whether the first graphic content when rendered as a first graphic object within the target pane is discernable by the user is determined based at least in part on a number of view clients that are active in the industrial process visualization.

10. A system for visualizing graphical content in an industrial process visualization, the system comprising:

a memory;

a display; and a processor configured to:

determine available destination real estate of a portion of a target pane of a client viewer of the industrial process visualization for rendering a first graphic content representative of at least a portion of an industrial process as a graphic object, wherein the target pane comprises an area of the display that is visible to a user of the industrial process visualization and wherein said portion of the target pane is located entirely within the target pane and includes no graphic content other than the first graphic content for rendering therein such that the first graphic content is visibly rendered on the display when rendered as a graphic object within said portion of the target pane;

determine, based at least in part on the determined available destination real estate and one or more properties of the client viewer, whether the first graphic content when visibly rendered on the display as a first graphic object within said portion of the target pane is discernable by the user of the industrial process visualization;

populate a data structure associated with a rendering tree with one of (i) the first graphic object if it is determined that the first graphic content is discernable by the user when visibly rendered on the display as the first graphic object within said portion of the target pane, and (ii) a second graphic object if it is determined that the first graphic content is not discernable by the user when visibly rendered on the display as the first graphic object within said portion of the target pane, wherein the second graphic object is a simplified rendering of the first graphic content and is discernable by the user when visibly rendered on the display within said portion of the target pane; wherein when the data structure is populated with said one of the first and second graphic objects the other of the first and second graphic objects is excluded from the data structure so that the industrial process visualization does not render said other of the first and second graphic objects.

11. The system of claim 10, wherein the first graphic object uses more memory than the second graphic object.

12. The system of claim 11, wherein said one or more properties of the client viewer includes a zoom factor.

13. The system of claim 10, wherein the processor is configured to:

after said populating a data structure, determine available destination real estate within the target pane of the client viewer for rendering a second graphic content;

determining if the second graphic content is discernable by the user when rendered as a third graphic object within the target pane based on one or more properties of the client viewer; and populating the data structure with one of the third graphic object if the second graphic content is discernable by the user when rendered as the third graphic object within the target pane, and a fourth graphic object if the second graphic content is not discernable by the user when rendered as the third graphic object within the target pane, wherein the fourth graphic object is a simplified rendering of the second graphic content and is discernable by the user within the target pane.

14. The system of claim 10, wherein the processor is configured to receive one of a request for a new window and a request to resize the pane before said determining available destination real estate.

15. The system of claim 10, wherein the processor is configured to:

determine, based at least in part on one or more properties of the client viewer, whether the first graphic content when rendered as the second graphic object within the target pane is discernable by user; and omit the first graphic content from the data structure if it is determined that the first graphic content when rendered as the second graphic object within the target pane is not discernable by user.

* * * * *